US012392202B2

(12) United States Patent
Lyon

(10) Patent No.: US 12,392,202 B2
(45) Date of Patent: Aug. 19, 2025

(54) DOWN-THE-HOLE DRILL HAMMER HAVING A RIBBED EXHAUST TUBE

(71) Applicant: Center Rock Inc., Berlin, PA (US)

(72) Inventor: Leland H. Lyon, Roanoke, VA (US)

(73) Assignee: Center Rock Inc., Berlin, PA (US)

( * ) Notice: Subject to any disclaimer, the term of this patent is extended or adjusted under 35 U.S.C. 154(b) by 63 days.

(21) Appl. No.: 18/484,900

(22) Filed: Oct. 11, 2023

(65) Prior Publication Data

US 2025/0122763 A1 Apr. 17, 2025

(51) Int. Cl.
*E21B 10/36* (2006.01)
*E21B 4/14* (2006.01)

(52) U.S. Cl.
CPC ..... *E21B 10/36* (2013.01); *E21B 4/14* (2013.01)

(58) Field of Classification Search
CPC ..... E21B 4/14; E21B 4/06; E21B 4/00; E21B 10/36
USPC ..... 175/414, 293, 296
See application file for complete search history.

(56) References Cited

U.S. PATENT DOCUMENTS 4,530,408 A * 7/1985 Toutant ..... E21B 4/14 173/136
4,819,746 A * 4/1989 Brown ..... E21B 44/005 175/215
5,131,476 A * 7/1992 Harrington ..... E21B 4/14 173/78
6,125,952 A * 10/2000 Beccu ..... E21B 4/14 173/78
2005/0173158 A1* 8/2005 Jacobsson ..... E21B 4/14 175/296
2009/0308661 A1* 12/2009 Wolfer ..... E21B 10/36 175/417
2016/0298390 A1* 10/2016 Kraft ..... E21B 10/36

* cited by examiner

*Primary Examiner* — George S Gray
(74) *Attorney, Agent, or Firm* — Kim IP Law Group LLC

(57) ABSTRACT

A down-the-hole hammer comprising a housing and a drill bit disposed about a distal end of the housing. The drill bit includes a head, a shank extending from the head, the shank including a bore having a plurality of ribs, and an exhaust tube configured to be coupled to the shank, the exhaust tube including a plurality of ribs for engaging the counterbore of the shank.

19 Claims, 6 Drawing Sheets

DOWN-THE-HOLE DRILL HAMMER HAVING A RIBBED EXHAUST TUBE

BACKGROUND

The present disclosure relates generally to a pneumatic down-the-hole drill hammer for drilling earth. In particular, the present disclosure relates to a down-the-hole drill hammer having a ribbed exhaust tube connectable to a drill bit.

Conventional down-the-hole drill ("DTH") hammers include drill bits configured to drill into earth such as rock. It is common in many models of pneumatic down-the-hole drill hammers to have drill bits that are fitted with a polymeric tube which functions as an exhaust valve for the return chamber of the tool. These tubes are commonly referred to as exhaust tubes or foot valves. The exhaust tube generally projects outwardly into a piston so that a return pressure chamber is sealed when the piston close to the drill bit and unsealed when the piston is spaced further away from the drill bit. This cooperation allows the return chamber to fill and exhaust with each impact cycle of the piston with the drill bit.

The most common method of securing the exhaust tube to the drill bit is by press fitting into a bore of the drill bit. However, during operation of the drill there are substantial impact forces applied to the drill bit which accelerates the drill bit into a rock working surface. This sudden acceleration imparts a similar acceleration on the exhaust tube which applies high stresses thereto making the exhaust tube prone to failure. This acceleration stress is also additive to adjacent radial interference stresses typically imparted onto conventional exhaust tubes. Consequently, a tube failure renders the tool inoperable. The project cost and frustration for a drilling contractor, especially in deep water well or geothermal holes, are considerable due to the many hours of time lost pulling and reinserting many lengths of drill pipe out of and back into the hole in order to replace the exhaust tube.

A need therefore still exists for an improved exhaust tube-to-bit fitment design that reduces acceleration and fitting stresses and mitigates exhaust tube failure.

BRIEF SUMMARY OF THE DISCLOSURE

In accordance with an exemplary embodiment, the subject disclosure provides a down-the-hole hammer comprising a housing, a drill bit disposed about a distal end of the housing, and an exhaust tube operatively engaged with the drill bit. The drill bit includes a head, a shank extending from the head, the shank including a bore having a plurality of ribs. The exhaust tube is configured to couple with the shank and includes a plurality of ribs for engaging the shank of the drill bit.

According to an aspect, the plurality of ribs of the exhaust tube are cooperating ribs for engaging the plurality of ribs of the shank. According to another aspect, the plurality of ribs of the exhaust tube extend coaxially with a longitudinal axis of the exhaust tube. According to another aspect, the plurality of ribs of the exhaust tube are annular. According to another aspect, the plurality of ribs of the shank extend coaxially with a longitudinal axis of the shank. According to another aspect, the plurality of ribs of the shank are annular. According to another aspect, the exhaust tube includes a tapered distal end and the plurality of ribs extend along the tapered distal end. According to another aspect, the plurality of ribs of the exhaust tube includes at least three ribs. According to another aspect, the tapered distal end extends less than about 50% of an overall longitudinal length of the exhaust tube. According to another aspect, the tapered distal end extends about a third of an overall longitudinal length of the exhaust tube.

In accordance with another exemplary embodiment, the subject disclosure provides an exhaust tube for a drill bit of a down-the-hole hammer comprising an overall length of about 3.5 to 4.5 inches and an overall diameter of about 1.2 to 2.3 inches, a uniform inner diameter throughout its overall length, a tapered distal end having a plurality of annular ribs spaced apart substantially throughout an entirety of the tapered distal end, wherein the tapered distal end tapers inwardly in the distal direction about 1 to 3 degrees.

According to an aspect, the plurality of ribs extend coaxially with a longitudinal axis of the exhaust tube. According to another aspect, the plurality of ribs includes at least three ribs. According to another aspect, the plurality of ribs are equidistantly disposed. According to another aspect, the plurality of ribs are annular ribs. According to another aspect, the exhaust tube further comprising an annular lip adjacent the tapered distal end. According to another aspect, the plurality of ribs include six annular ribs. According to another aspect, each of the plurality of ribs have a differing overall diameter. According to another aspect, none of the plurality of ribs have the same overall diameter.

BRIEF DESCRIPTION OF THE SEVERAL VIEWS OF THE DRAWINGS

The foregoing summary, as well as the following detailed description of the exemplary embodiments of the invention, will be better understood when read in conjunction with the appended drawings. For the purpose of illustrating the invention, there are shown in the drawings exemplary embodiments. It should be understood, however, that the subject disclosure is not limited to the precise arrangements and instrumentalities shown.

In the drawings.

DETAILED DESCRIPTION OF THE INVENTION

Figure 1:
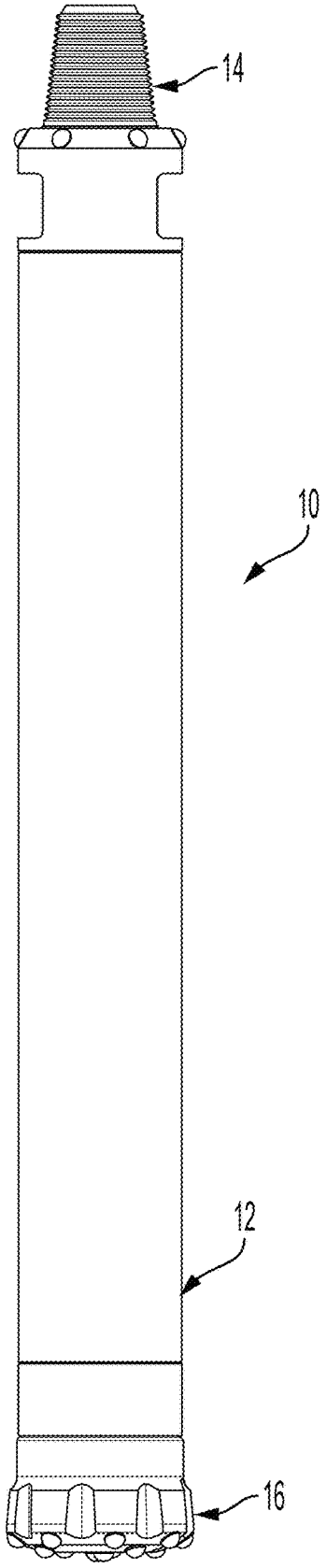
FIG. 1 is an elevational view of a down-the-hole hammer according to an exemplary embodiment of the subject disclosure.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject disclosure in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art. "Exemplary" as used herein shall mean serving as an example.

Throughout this disclosure, various aspects of the subject disclosure can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the present disclosure can be practiced without one or more of the specific features or advantages of a particular exemplary embodiment. In other instances, additional features and advantages may be recognized in certain embodiments that may not be present in all exemplary embodiments of the subject disclosure.

In accordance with an exemplary embodiment, the subject disclosure provides a down-the-hole hammer 10, as shown in FIGS. 1-8. The DTH hammer 10 includes a housing 12, a back head 14 disposed about a proximal end of the housing, a drill bit 16 disposed about a distal end of the housing, and an exhaust tube 20. The exhaust tube 20 is housed within the housing 12 and is configured to be coupled to the drill bit 16 and received within a piston 21.

The drill bit includes a head 16*a* and a shank 17 extending from the head. The shank 17 including an engagement portion or bore 24*a* having a plurality of ribs 34.

The exhaust tube 20 is configured to be coupled to the shank, the exhaust tube including a plurality of ribs 22 for engaging the bore of the shank. More particularly, the plurality of ribs 22 of the exhaust tube 10 are cooperating ribs for engaging the plurality of ribs 34 of the shank 17. For example, the plurality of ribs 22 press-fittingly engages with the plurality of ribs 34 of the shank, or alternatively, the plurality of ribs 22 engages with the plurality of ribs 34 of the shank via an interference fit.

The back head 14 can be any conventional back head 14 readily used in DTH hammers. The back head 14 is threaded or otherwise configured for a connection to an unillustrated drill string or another power source. The structure and operation of such back heads 14 are readily known in the art and a detailed description of them is not necessary for a complete understanding of the subject disclosure. However, exemplary back heads 14 suitable for use in the present exemplary embodiments are described in, e.g., U.S. Pat. Nos. 5,711,205 and 8,397,839, the entire disclosures of which are hereby incorporated by reference for all purposes.

Figure 2:
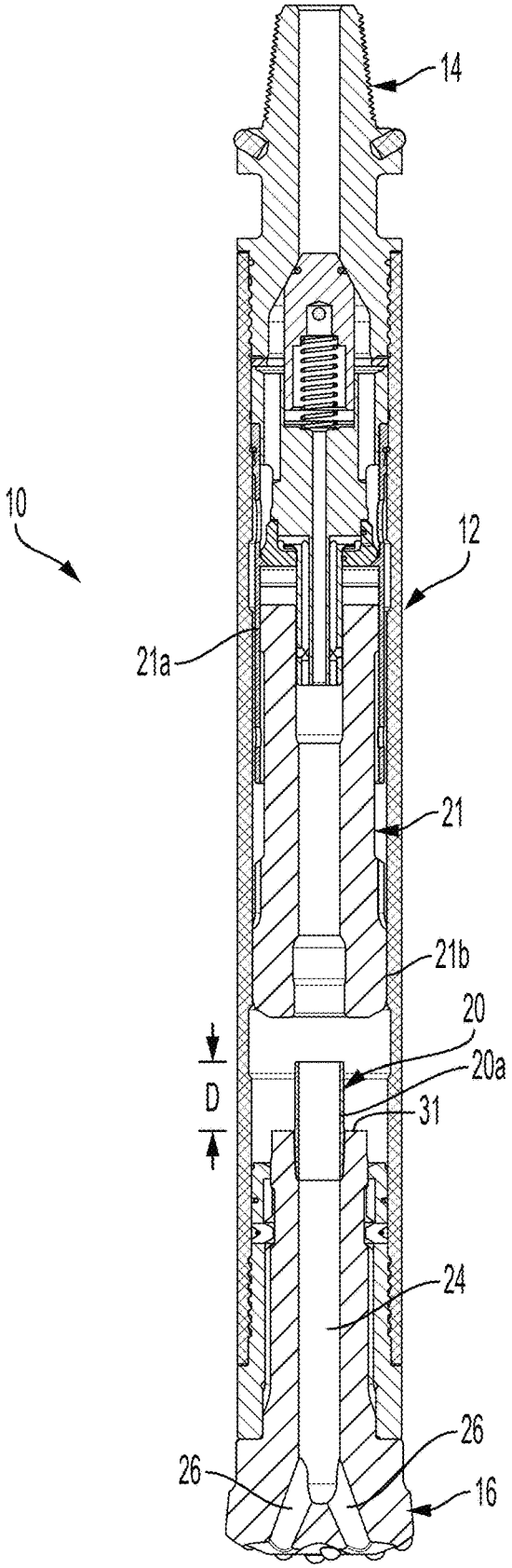
FIG. 2 is an elevational cross-sectional view of the down-the-hole hammer of FIG. 1.
Figure 3:
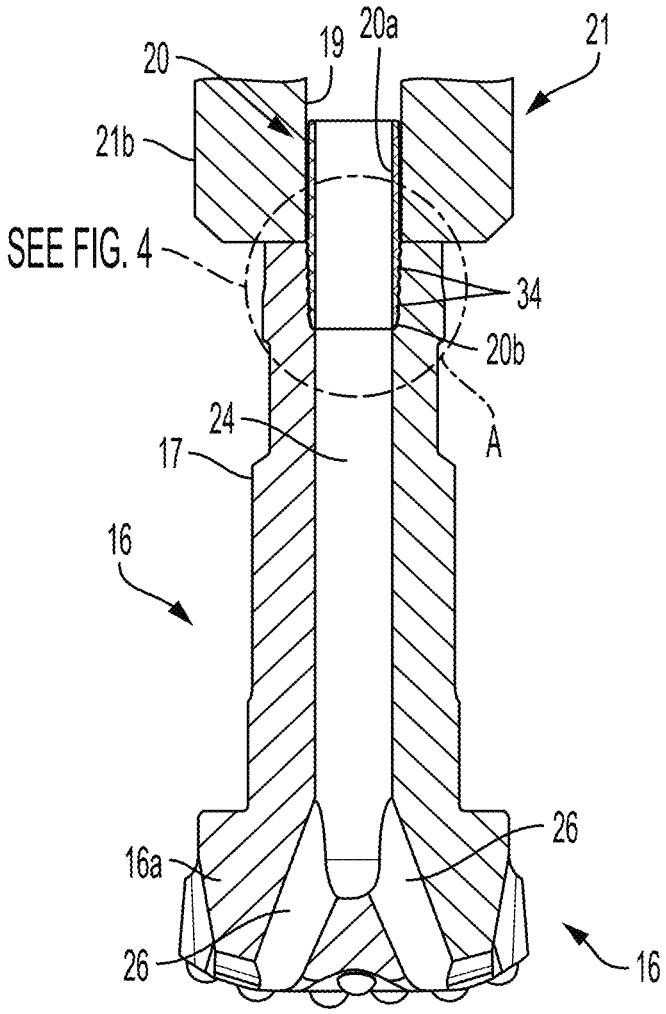
FIG. 3 is an elevational cross-sectional view of a drill bit, an exhaust tube and a lower portion of a piston of the down-the-hole hammer of FIG. 1.

The housing 12 has a generally cylindrical configuration and at least partially houses the back head 14 and drill bit 16. The housing 12 also houses the exhaust tube 20 and the piston 21 (which is best shown in FIG. 2). The piston 21 includes a proximal end 21*a* and a distal end 21*b* that is configured to contact the shank 17 of the drill bit 16 during operation. The piston 21 is movable between a first position where the piston 21 is disposed away from the drill bit 16 and a second position where the piston 21 is in contact with the drill bit. The piston 21 includes a central bore 19 configured along a central longitudinal axis of the piston to provide a fluid pathway therethrough and to accommodate a proximal portion 20*a* of the exhaust tube 20. The piston operates in a percussive manner during operations.

In the example shown, the exhaust tube 20 is generally cylindrical or annular having a longitudinal axis "B" and defining an through hole therethrough. In some examples, the through hole has the same or equivalent diameter as a central bore 25 of the drill bit 16 to allow unobstructed fluid flow therethrough. The central bore 25 is in fluid communication with the bore 24. As best shown in FIG. 2, when installed in the drill bit 16, the proximal portion 20*a* of the exhaust tube 20 extends a predetermined distance "D" from a proximally facing impact surface 31 of the drill bit. The predetermined distance D can be about 0.5, 1, 1.5, 2, 2.5, 3, 3.5, 4, 4.5, or more, and preferably about 2 inches. So constructed and arranged, a sealed return pressure chamber is created between the exhaust tube 20 and central bore 19 of the piston 21 when the piston is less than or equal to the predetermined distance D from the drill bit 16. Conversely, when the piston 21 is at a greater distance from the drill bit than the predetermined distance D, the seal between the piston and the exhaust tube 20 is broken (see FIG. 2). This arrangement allows the return chamber to fill with working fluid and exhaust the working fluid with each percussive cycle of the piston 21. In some examples, the exhaust tube 20 can be comprised of e.g., DELRAN® or acetyl plastic, and the like, although various other materials are contemplated. Further, the exhaust tube 20 includes a plurality of ribs 22, as further described below, which are disposed about the distal portion 20*b* thereof.

According to an exemplary embodiment, the plurality of ribs 22 extend from the distal end less than 50% of the overall length of the exhaust tube 20. However, it is contemplated that the plurality of ribs 22 may extend the entire length of the exhaust tube 20 or may extend a third or less of the overall length of the exhaust tube 20. In some examples, the distal portion 20*b* of the exhaust tube 20 is tapered and the plurality of ribs extend along the tapered distal portion (or tapered distal end). The plurality of ribs can extend along the entirety of the tapered distal portion or a portion of the tapered distal portion. Such tapering facilitates installation of the exhaust tube into the drill bit 16 and reduces damage to the exhaust tube during operation.

According to an exemplary embodiment, the exhaust tube 20 has an overall length of about 3.5 to 4.5 inches, including 3, 3.1, 3.2, 3.3, 3.4, 3.6, 3.7, 3.8, 3.9, 4, 4.1, 4.2, 4.3, 4.4, 4.6 4.7, 4.8, 4.9, and 5 inches or more, and an overall diameter of about 1.2 to 2.3 inches, including 1.1, 1.25, 1.3, 1.4, 1.5, 1.6, 1.7, 1.8, 1.9, 2, 2.1, 2.2, 2.25, 2.3, 2.4, 2.5, 2.6, 2.7 and 2.8 or more inches, and preferably about 1.25 to 2.25 inches. The inner diameter is uniform throughout the overall length of the exhaust tube. That is, the inner diameter is a constant diameter throughout the overall length of the exhaust tube. The tapered distal end of the exhaust tube can taper inwardly in the distal direction about 1 to 3 degrees, including 0.5, 1.5, 2.0, 2.5, 3.5 4.0, 4.5 and 5 degrees or more.

Figure 5:
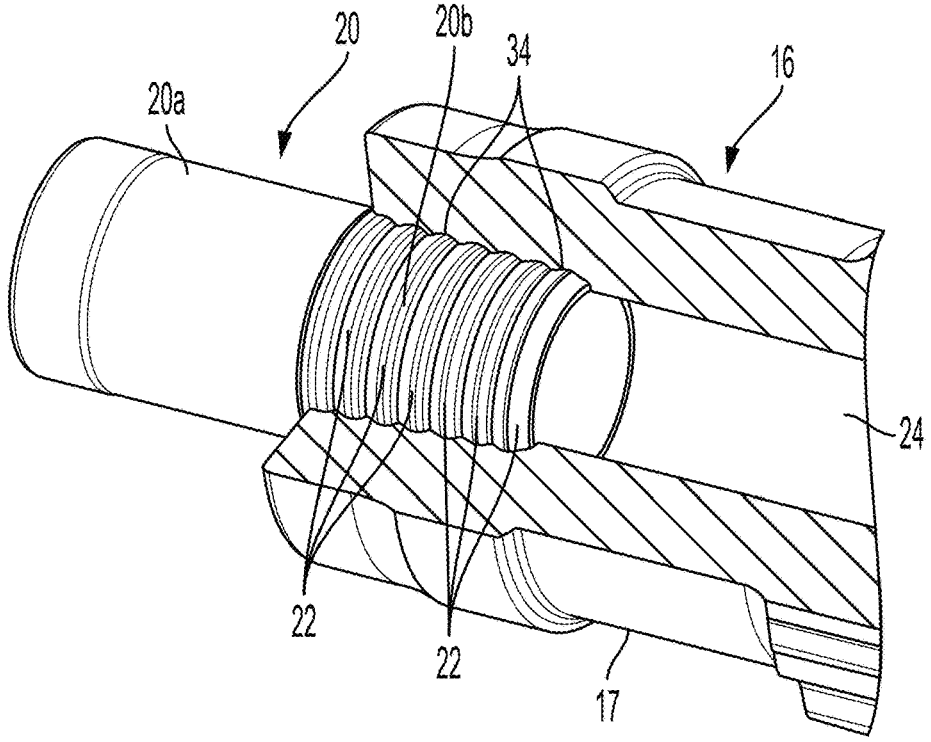
FIG. 5 is a perspective enlarged partial cross-sectional view of the exhaust tube and the drill bit of the down-the-hole hammer of FIG. 1.
Figure 6:
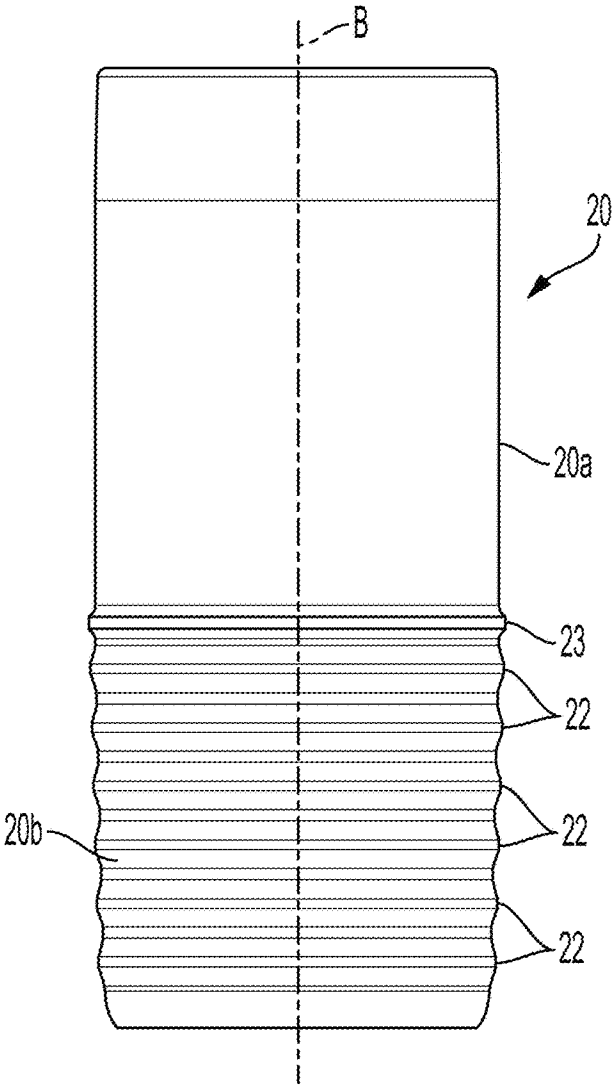
FIG. 6 is an elevational view of an exhaust tube of the down-the-hole hammer of FIG. 1.
Figure 8:
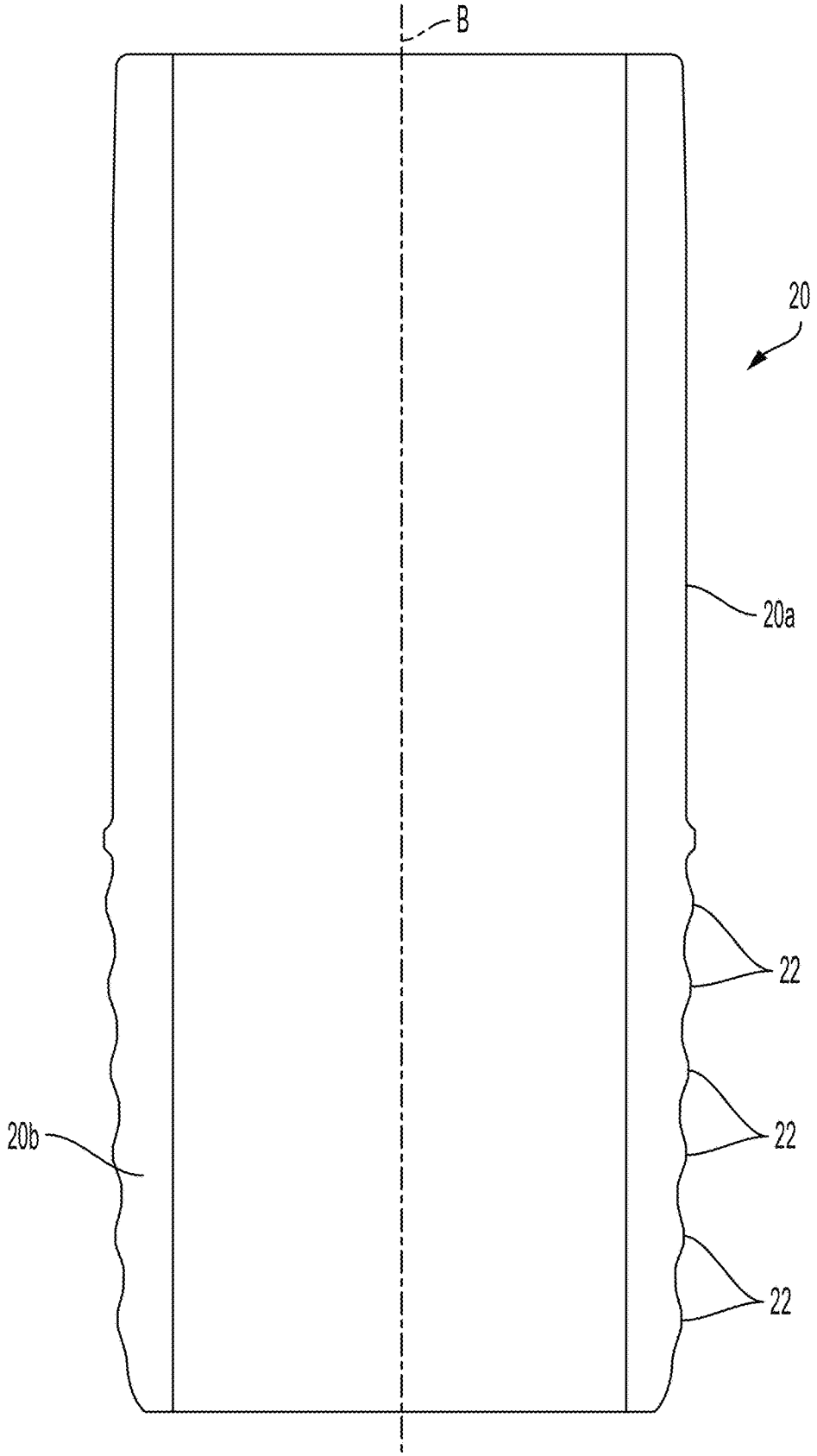
FIG. 8 is a longitudinal cross-sectional view of the exhaust tube of FIG. 6.

According to an exemplary embodiment as best shown in FIGS. 5 and 6, the plurality of ribs 22 are annular ribs and extend coaxilly with a longitudinal axis B of the exhaust tube 20. Each of the plurality of ribs also extend in a direction transvers or substantially perpendicular to the longitudinal axis of the exhaust tube. It is also contemplated that the ribs 22 may be offset or oblong such that the ribs 22 are not co-axially aligned with the longitudinal axis B of the exhaust tube 20. The plurality of ribs 22 includes two or more ribs. However, it is also contemplated that the plurality of ribs 22 may include three or more ribs 22, four or more ribs 22, five or more ribs 22, six or more ribs 22, seven or more ribs 22, eight or more ribs 22, nine or more ribs 22, ten or more ribs 22, as conditions may dictate.

In the example shown, the width of the spaces between peaks of the ribs 22 are essentially equal to the width of the ribs themselves, and the ribs are equidistantly disposed about the distal portion 20*b* of the exhaust tube 20. However, it is contemplated that the ribs 22 may be more or less spaced apart, as desired. Further, each of the plurality of ribs 22 have differing overall diameters. Furthermore, none of the plurality of ribs 22 have the same overall diameter.

Referring to FIG. 6, the exhaust tube 20 also includes an annular lip 23 adjacent the tapered distal end. Specifically, the annular lip is a radially outwardly extending lip positioned about the start of the tapered portion.

As best shown in FIG. 1, the drill bit 16 is located proximate a distal end of the housing 12 and coupled to the DTH hammer 10 about its distal end. In some examples, the drill bit 16 is a single integral piece and is configured with the head 16*a* and the shank 17. The head 16*a* includes a plurality of inserts (also known as cutting inserts).

As best shown in FIGS. 2, 3, 5 and 7, the drill bit 16 also includes the central bore 25 therethrough. In the example shown, the bore 24 extends from the proximal end of the drill bit 16 leading to the central bore 25 which extends towards the distal end of the drill bit 16. The central bore 25 fluidly communicates with the bore 24 and a plurality of angled bores 26 which extend to the distal cutting surface of the drill bit 16. The central bore along with the angled bores 26 are configured to allow fluid to flow through the drill bit 16. The central bore 25 can have a uniform diameter throughout its length. According to an exemplary embodiment, the central bore 25 includes the aforementioned engagement portion or bore 24 having larger diameter at its proximal end, i.e., it is tapered, to enable engagement with the exhaust tube 20 such that the inner diameter of the exhaust tube 20 and the remainder of the central bore 25 have the same diameter. In the example shown, the bore 24 is configured as a countersink having a plurality of ribs 34. The ribs 34 may be any size or shape and are configured to engage corresponding ribs 22 on the exhaust tube 20 to prevent axial movement between the drill bit 16 and the exhaust tube 20. In some examples, the cooperating plurality of ribs 34 of the shank 17 are annular ribs extending coaxially with a longitudinal axis "C" of the shank, and each of the plurality of ribs extends in a direction transverse or substantially perpendicular to the longitudinal axis of the shank. When the exhaust tube 20 is connected to the drill bit 17, the longitudinal axis B of the exhaust tube is essentially collinear with the longitudinal axis C of the shank.

Figure 4:
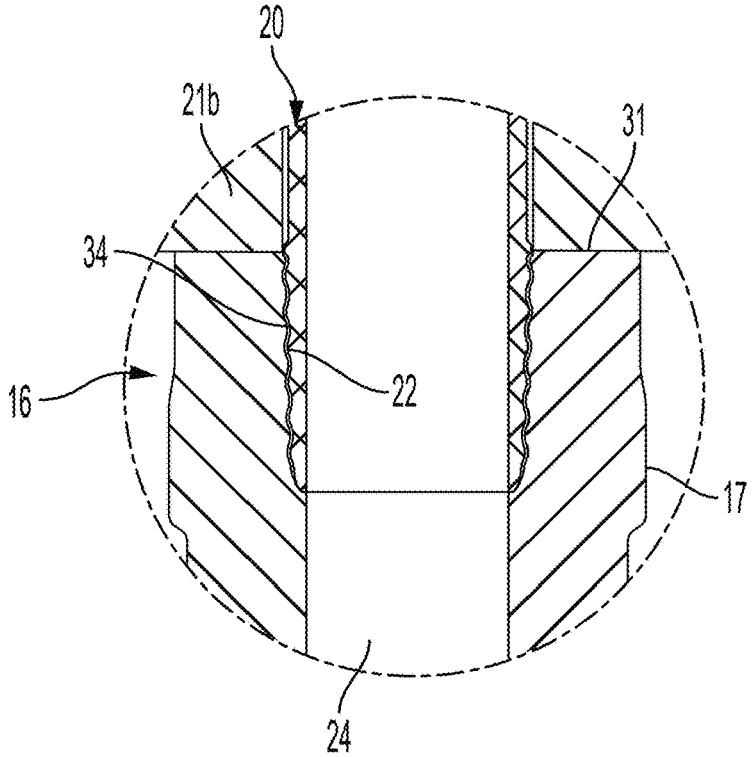
FIG. 4 is an enlarged view of the encircled region "A" of FIG. 3.
Figure 7:
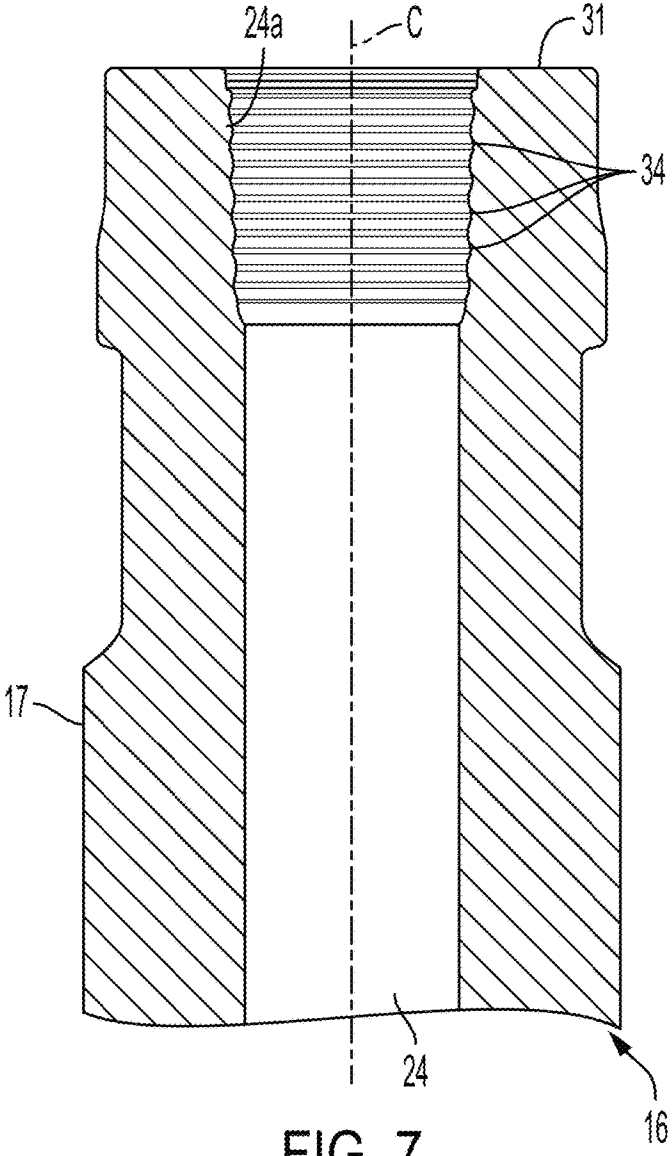
FIG. 7 is a longitudinal cross-sectional view of the drill bit of the down-the-hole hammer of FIG. 1.

As shown in FIGS. 2, 4 and 7, the shank 17 further includes the proximally facing impact surface 31 about the bore opening on the proximal end of the shank. The piston 21 operably engages the impact surface 31 during operation.

In operation, the back head 14 is coupled to a drill string or other power source. When desired, the DTH hammer 10 is activated and the piston 21 moves percussively within the hammer where the piston 21 percussively engages the impact surface of the shank 17 to provide acceleration to force of the drill bit 16 into the earth. This acceleration imparts a similar acceleration on the exhaust tube 20. Owing to the configuration of the exhaust tube 20 as described herein, the exhaust tube advantageously reduces stresses due to acceleration forces and fitting stresses on the exhaust tube 20 and drill bit 16 and therefore mitigates failure of the exhaust tube 20 during operations.

It will be appreciated by those skilled in the art that changes could be made to the various aspects described above without departing from the broad inventive concept thereof. It is to be understood, therefore, that the subject application is not limited to the particular aspects disclosed, but it is intended to cover modifications within the spirit and scope of the subject application as defined by the appended claims.

I claim:

1. A down-the-hole hammer comprising:

a housing;

a drill bit disposed about a distal end of the housing, the drill bit including:

a head, and a shank extending from the head, the shank including a bore having a plurality of ribs; and an exhaust tube configured to be coupled to the shank, the exhaust tube including an inwardly tapered distal end having a plurality of ribs for engaging the plurality of ribs of the shank.

2. The down-the-hole hammer of claim 1, wherein the plurality of ribs of the exhaust tube are cooperating ribs for engaging the plurality of ribs of the shank.

3. The down-the-hole hammer of claim 1, wherein the plurality of ribs of the exhaust tube extend coaxially with a longitudinal axis of the exhaust tube.

4. The down-the-hole hammer of claim 1, wherein the plurality of ribs of the exhaust tube are annular ribs.

5. The down-the-hole hammer of claim 1, wherein the plurality of ribs of the shank extend coaxially with a longitudinal axis of the shank.

6. The down-the-hole hammer of claim 1, wherein the plurality of ribs of the shank are annular ribs.

7. The down-the-hole hammer of claim 1, wherein the exhaust tube includes a tapered distal portion and the plurality of ribs extend along the tapered distal portion.

8. The down-the-hole hammer of claim 7, wherein the tapered distal portion extends less than about 50% of an overall length of the exhaust tube.

9. The down-the-hole hammer of claim 7, wherein the tapered distal portion extends about a third of an overall length of the exhaust tube.

10. The down-the-hole hammer of claim 1, wherein the plurality of ribs of the exhaust tube include at least three ribs.

11. An exhaust tube for a drill bit of a down-the-hole hammer comprising:

an overall length of about 3.5 to 4.5 inches and an overall diameter of about 1.2 to 2.3 inches;

a uniform inner diameter throughout its overall length; and a tapered distal end having a plurality of ribs spaced apart substantially throughout an entirety of the tapered distal end, wherein the tapered distal end tapers inwardly in the distal direction about 1 to 3 degrees.

12. The exhaust tube of claim 11, wherein the plurality of ribs extend coaxially with a longitudinal axis of the exhaust tube.

13. The exhaust tube of claim 11, wherein the plurality of ribs includes at least three ribs.

14. The exhaust tube of claim 11, wherein the plurality of ribs are equidistantly disposed.

15. The exhaust tube of claim 11, wherein the plurality of ribs are annular ribs.

16. The exhaust tube of claim 11, further comprising an annular lip adjacent the tapered distal end.

17. The exhaust tube of claim 11, wherein the plurality of ribs include six annular ribs.

18. The exhaust tube of claim 11, wherein each of the plurality of ribs have a differing overall diameter.

19. The exhaust tube of claim 11, wherein none of the plurality of ribs have the same overall diameter.

* * * * *